US009107015B2

(12) United States Patent
Zhang et al.

(10) Patent No.: US 9,107,015 B2
(45) Date of Patent: Aug. 11, 2015

(54) SYSTEM FOR AUTOMATIC FITTING USING REAL EAR MEASUREMENT

(75) Inventors: Tao Zhang, Eden Prairie, MN (US); Joyce Rosenthal, Golden Valley, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 236 days.

(21) Appl. No.: 12/730,380

(22) Filed: Mar. 24, 2010

(65) Prior Publication Data

US 2010/0246869 A1 Sep. 30, 2010

Related U.S. Application Data

(60) Provisional application No. 61/164,347, filed on Mar. 27, 2009.

(51) Int. Cl.
*H04R 25/00* (2006.01)

(52) U.S. Cl.
CPC ..... *H04R 25/70* (2013.01); *H04R 25/305* (2013.01)

(58) Field of Classification Search
CPC ..... H04R 25/00; H04R 25/30; H04R 25/305; H04R 25/505; H04R 25/70
USPC ..... 381/312–331
See application file for complete search history.

(56) References Cited

U.S. PATENT DOCUMENTS 3,491,214 A 1/1970 Rosemond et al.
4,564,955 A 1/1986 Birch et al.
4,596,902 A * 6/1986 Gilman ..... 381/320
4,809,708 A 3/1989 Geisler et al.
5,386,475 A 1/1995 Birck et al.
5,699,809 A 12/1997 Combs et al.
5,711,308 A 1/1998 Singer (Continued)

FOREIGN PATENT DOCUMENTS

AU 5830898 A 9/1998
AU 2010200103 B2 7/2011

(Continued)

OTHER PUBLICATIONS

"U.S. Appl. No. 12/102,602, Final Office Action mailed Aug. 24, 2012", 7 pgs.

(Continued)

*Primary Examiner* — Matthew Eason
(74) *Attorney, Agent, or Firm* — Schwegman Lundberg & Woessner, P.A.

(57) ABSTRACT

According to a method embodiment for performing a real ear measurement (REM), a stimulus signal is transformed into a frequency domain stimulus signal with a plurality of frequency ranges. The frequency domain stimulus signal is amplified with a desired gain for each of the plurality of frequency ranges to provide an amplified stimulus signal. The amplified stimulus signal is transformed into the acoustic signal in the ear canal, which is detected to provide a detected acoustic signal, and the detected acoustic signal is transformed into a frequency domain detected signal with the plurality of frequency ranges. A sound level for the plurality of frequency ranges is measured. The desired gain for the frequency ranges is automatically adjusted based on the measured sound levels and the desired sound pressure levels for the plurality of frequency ranges. The method can be performed within a hearing assistance apparatus.

20 Claims, 6 Drawing Sheets

(56) References Cited

U.S. PATENT DOCUMENTS

| | | | | |
|---|---|---|---|---|
| 5,792,073 | A | 8/1998 | Keefe | |
| 5,868,682 | A | 2/1999 | Combs et al. | |
| 5,897,494 | A | 4/1999 | Flock et al. | |
| 5,987,146 | A | 11/1999 | Pluvinage et al. | |
| 6,007,494 | A | 12/1999 | Zenner et al. | |
| D431,294 | S | 9/2000 | Barnard et al. | |
| 6,154,546 | A | 11/2000 | Uvacek | |
| 6,674,862 | B1 | 1/2004 | Magilen | |
| D506,258 | S | 6/2005 | Nielsen | |
| 7,239,711 | B1 | 7/2007 | Andersen et al. | |
| 7,599,508 | B1 | 10/2009 | Lynch et al. | |
| 7,756,283 | B2 | 7/2010 | Bramslow | |
| 7,778,424 | B2 | 8/2010 | Lange | |
| 8,059,847 | B2 | 11/2011 | Nordahn | |
| 8,196,470 | B2 | 6/2012 | Gross et al. | |
| 8,315,402 | B2 | 11/2012 | Zhang et al. | |
| 8,374,370 | B2 | 2/2013 | Zhang et al. | |
| 8,452,021 | B2 | 5/2013 | Yanz et al. | |
| 8,542,841 | B2 | 9/2013 | Lopresti et al. | |
| 8,571,224 | B2 | 10/2013 | Recker et al. | |
| 8,712,081 | B2 | 4/2014 | Yanz et al. | |
| 2002/0085729 | A1 | 7/2002 | Marx | |
| 2004/0028250 | A1* | 2/2004 | Shim | 381/312 |
| 2004/0044389 | A1 | 3/2004 | Crawford | |
| 2004/0234094 | A1 | 11/2004 | Saunders et al. | |
| 2005/0002539 | A1 | 1/2005 | Nielsen | |
| 2006/0045282 | A1 | 3/2006 | Reber | |
| 2006/0171550 | A1 | 8/2006 | Bryant et al. | |
| 2007/0009107 | A1* | 1/2007 | Lange | 381/60 |
| 2007/0204695 | A1 | 9/2007 | Gross et al. | |
| 2007/0217639 | A1 | 9/2007 | Stirnemann | |
| 2008/0152178 | A1 | 6/2008 | Topholm et al. | |
| 2008/0194984 | A1 | 8/2008 | Keefe | |
| 2008/0260192 | A1 | 10/2008 | Yanz et al. | |
| 2008/0260193 | A1 | 10/2008 | Westermann et al. | |
| 2008/0298600 | A1* | 12/2008 | Poe et al. | 381/60 |
| 2009/0245525 | A1 | 10/2009 | Zhang et al. | |
| 2009/0245560 | A1 | 10/2009 | Zhang et al. | |
| 2009/0299215 | A1 | 12/2009 | Zhang | |
| 2010/0202642 | A1 | 8/2010 | LoPresti et al. | |
| 2010/0260343 | A1 | 10/2010 | Recker et al. | |
| 2011/0098551 | A1 | 4/2011 | Zhang | |
| 2012/0067107 | A1 | 3/2012 | Gross et al. | |
| 2013/0251166 | A1 | 9/2013 | Yanz et al. | |
| 2014/0018698 | A1 | 1/2014 | Lopresti et al. | |

FOREIGN PATENT DOCUMENTS

| | | | |
|---|---|---|---|
| AU | 2010201189 | | 9/2011 |
| AU | 2009201227 | B2 | 10/2011 |
| AU | 2009201228 | B2 | 1/2012 |
| AU | 2009280002 | B2 | 10/2012 |
| DE | 4327634 | C1 | 6/1994 |
| EP | 0381608 | A2 | 8/1990 |
| EP | 1448014 | B1 | 10/2005 |
| EP | 1705950 | A2 | 9/2006 |
| EP | 2107831 | A2 | 10/2009 |
| EP | 2323553 | B1 | 10/2012 |
| EP | 2107830 | B1 | 5/2014 |
| WO | WO-8901315 | A1 | 2/1989 |
| WO | WO-9931936 | A1 | 6/1999 |
| WO | WO-0239784 | A1 | 5/2002 |
| WO | WO-2005089016 | A1 | 9/2005 |
| WO | WO-2007045254 | A1 | 4/2007 |
| WO | WO-2007045271 | A1 | 4/2007 |
| WO | WO-2008017326 | A1 | 2/2008 |
| WO | WO-2010016925 | A1 | 2/2010 |

OTHER PUBLICATIONS

"U.S. Appl. No. 12/102,602, Non Final Office Action mailed Apr. 4, 2012", 7 pgs.
"U.S. Appl. No. 12/102,602, Response filed to Restriction Requirement mailed Dec. 8, 2011", 8 pgs.
"U.S. Appl. No. 12/102,602, Response filed Jul. 2, 2012 to Non Final Office Action mailed Apr. 4, 2012", 11 pgs.
"U.S. Appl. No. 12/102,602, Response filed Dec. 26, 2012 to Final Office Action mailed Aug. 24, 2012", 8 pgs.
"U.S. Appl. No. 12/102,602, Restriction Requirement mailed Nov. 8, 2011", 6 pgs.
"U.S. Appl. No. 12/130,764, Non-Final Office Action mailed Aug. 20, 2010", 8 pgs.
"U.S. Appl. No. 12/130,764, Preliminary Amendment mailed Jul. 21, 2008", 6 pgs.
"U.S. Appl. No. 12/130,764, Response filed Jul. 30, 2010 to Restriction Requirement mailed Jul. 29, 2010", 7 Pgs.
"U.S. Appl. No. 12/130,764, Restriction Requirement mailed Jul. 29, 2010", 9 pgs.
"U.S. Appl. No. 12/414,876, Non Final Office Action mailed Aug. 12, 2011", 8 pgs.
"U.S. Appl. No. 12/414,876, Notice of Allowance mailed Jan. 11, 2012", 5 pgs.
"U.S. Appl. No. 12/414,876, Notice of Allowance mailed Oct. 11, 2012", 5 pgs.
"U.S. Appl. No. 12/414,876, Response filed Dec. 12, 2011 to Non Final Office Action mailed Aug. 1/2, 2011", 9 pgs.
"U.S. Appl. No. 12/414,889, Non Final Office Action mailed Dec. 15, 2011", 11 pgs.
"U.S. Appl. No. 12/414,889, Notice of Allowance mailed Jul. 18, 2012", 7 pgs.
"U.S. Appl. No. 12/414,889, Response filed Jun. 14, 2012 to Non Final Office Action mailed Dec. 15, 2011", 9 pgs.
"U.S. Appl. No. 12/537,908 , Response filed Jan. 11, 2012 to Non Final Office Action mailed Oct. 11, 2011", 9 pgs.
"U.S. Appl. No. 12/537,908, Final Office Action mailed Mar. 15, 2012", 11 pgs.
"U.S. Appl. No. 12/537,908, Non Final Office Action mailed Oct. 9, 2012", 12 pgs.
"U.S. Appl. No. 12/537,908, Non Final Office Action mailed Oct. 11, 2011", 10 pgs.
"U.S. Appl. No. 12/537,908, Preliminary Amendment mailed Jun. 22, 2010", 3 pgs.
"U.S. Appl. No. 12/537,908, Response filed Jan. 9, 2013 to Non Final Office Action mailed Oct. 9, 2012", 9 pgs.
"U.S. Appl. No. 12/537,908, Response filed Sep. 12, 2012 to Final Office Action mailed Mar. 15, 2012", 9 pgs.
"U.S. Appl. No. 12/685,295 , Response filed Jan. 7, 2013 to Non Final Office Action mailed Nov. 7, 2012", 8 pgs.
"U.S. Appl. No. 12/685,295 , Response filed Aug. 13, 2012 to Non Final Office Action mailed Mar. 12, 2012", 8 pgs.
"U.S. Appl. No. 12/685,295, Final Office Action mailed Nov. 7, 2012", 8 pgs.
"U.S. Appl. No. 12/685,295, Non Final Office Action mailed Mar. 12, 2012", 7 pgs.
"U.S. Appl. No. 12/980,745, Preliminary Amendment mailed Feb. 14, 2011", 5 pgs.
"Australian Application Serial No. 2009201227, First Examiner Report mailed Apr. 20, 2010", 2 Pgs.
"Australian Application Serial No. 2009201227, Response filed Apr. 18, 2011 to First Examiner Report mailed Apr. 20, 2010", 9 pgs.
"Australian Application Serial No. 2009201228, First Examiner Report mailed Apr. 23, 2010", 1 pg.
"Australian Application Serial No. 2009201228, Office Action Response Filed Aug. 3, 2011", 5 pgs.
"Australian Application Serial No. 2009280002, Office Action Response Filed Sep. 17, 2012", 13.
"Australian Application Serial No. 2010200103, First Examiner Report mailed Feb. 2, 2011", 2 pgs.
"Australian Application Serial No. 2010200103, Response filed Jul. 8, 2011 to First Examiner Report mailed Feb. 2, 2011", 5 pgs.
"Australian Application Serial No. 2010201189, Examiner Report mailed Mar. 11, 2011", 1 pg.
"Australian Application Serial No. 2010201189, Response filed May 19, 2011 to Examiner Report mailed Mar. 11, 2011", 1 pg.
"Australian Application Serial No. 2009201228, Subsequent Examiner Report mailed Jun. 23, 2011", 2 pgs.

(56) References Cited

OTHER PUBLICATIONS

"Australian Application Serial No. 2009280002, Office Action Mailed Mar. 23, 2012", 2 Pgs.
"European Application Serial No. 08251441.5, Extended Search Report mailed Dec. 20, 2011", 18 pgs.
"European Application Serial No. 08251441.5, Response filed Jul. 5, 2012 to Extended Search Report mailed Dec. 20, 2011", 15 pgs.
"European Application Serial No. 09250957.9, Extended European Search Report mailed Dec. 13, 2010", 5 pgs.
"European Application Serial No. 09250957.9, Response filed Jul. 5, 2011 to Extended European Search Report mailed Dec. 13, 2010", 16 pgs.
"European Application Serial No. 09250958.7, Extended European Search Report mailed Nov. 29, 2010", 5 pgs.
"European Application Serial No. 09250958.7, Response filed Jun. 24, 2011 to Extended European Search Report mailed Nov. 29, 2010", 5 pgs.
"European Application Serial No. 10250039.4, Extended Search Report mailed Apr. 16, 2012", 8 pgs.
"European Application Serial No. 10250039.4, Response filed Nov. 16, 2012 to Extended Search Report mailed Apr. 16, 2012", 10 pgs.
"European Application Serial No. 10250568.2, Extended Search Report mailed Dec. 13, 2011", 8 pgs.
"European Application Serial No. 10250568.2, Office Action mailed Jan. 16, 2012", 2 pgs.
"European Application Serial No. 10250568.2, Response filed Jul. 10, 2012 to Extended Search Report mailed Dec. 13, 2011", 11 pgs.
"European Application Serial No. 08251441.5, Partial European Search Report mailed Jul. 14, 2011", 5 pgs.
"International Application Serial No. PCT/US2009/004528, International Preliminary Report on Patentability mailed Feb. 17, 2011", 6 pgs.
"International Application Serial No. PCT/US2009/004528, Search Report mailed Oct. 13, 2009", 7 pgs.
"International Application Serial No. PCT/US2009/004528, Written Opinion mailed Oct. 13, 2009", 7 pgs.
Chan, C K, et al., "Estimation of Eardrum Acoustic Pressure and of Ear Canal Length From Remote Points in the Canal Length From Remote Points in the Canal", Journal of the Acoustical Society of America, vol. 87, No. 3, XP009035813 ISSN: 0001-4966, (Mar. 1, 1990), 1237-1247.
Dillon,Ph.D., Harvey, "Hearing Aids", 4.4 Practical Issues in Real-Ear Testing, (Jan. 1, 2001), 101-104.
Hudde, H, et al., "Methods for Estimating the sound pressure at the eardrum", Journal of the Acoustical Society of America, vol. 106, No. 4, XP012001248 ISSN: 0001-4966, (Oct. 1, 2009), 1977-1992.
Moodie, K Shane, et al., "Procedure for Predicting Real-Ear Hearing Aid Performance in Young Children", Am. Journal of Audiology, Am. Speech-Language-Hearing Association, 3(1), (Mar. 1, 1994), 23-31.
Munro, Kevin J, et al., "Measuring the Real-Ear to Coupler Difference Transfer Function with and Insert Earphone and a Hearing Instrument: Are they the same?", Ear and Hearing, 26(1), (Feb. 1, 2005), 27-34.
Pascal, Jerome, et al., "Linear and nonlinear model of the human middle ear", J. Acoust. Soc. Am., vol. 104, No. 3, Pt. 1, (Sep. 1998), 1509-1516.
Yanz, Jerry, et al., "Real Ear Measurement System Using Thin Tube", U.S. Appl. No. 60/912,343, filed Apr. 17, 2007, 19 pgs.
U.S. Appl. No. 12/102,602, Notice of Allowance mailed Jan. 25, 2013, 5 pgs.
U.S. Appl. No. 12/685,295, Notice of Allowance mailed Jan. 31, 2013, 5 pgs.
U.S. Appl. No. 12/685,295, Notice of Allowance mailed May 17, 2013, 6 pgs.
European Application Serial No. 10250039.4, Examination Report mailed Jan. 16, 2013, 4 pgs.
European Application Serial No. 10250568.2, Examination Notification Art. 94(3) mailed Apr. 17, 2013, 8 pgs.
"U.S. Appl. No. 12/537,908, Notice of Allowance mailed Jun. 27, 2013", 10 pgs.
"U.S. Appl. No. 13/902,135, Non Final Office Action mailed Aug. 28, 2013", 6 pgs.
"U.S. Appl. No. 13/902,135, Notice of Allowance mailed Dec. 11, 2013", 10 pgs.
"U.S. Appl. No. 13/902,135, Preliminary Amendment mailed Mar. 31, 2013", 6 pgs.
"U.S. Appl. No. 13/902,135, Response filed Nov. 26, 2013 to Non Final Office Action mailed Aug. 28, 2013", 9 pgs.
"European Application Serial No. 09250958.7, Examination Notification Art. 94(3) mailed Jun. 11, 2013", 3 pgs.
"European Application Serial No. 09250958.7, Response filed Oct. 1, 2013 to Examination Notification Art. 94(3) mailed Jun. 11, 2013", 7 pgs.
"European Application Serial No. 10250039.4, Examination Notification Art. 94(3) mailed Aug. 1, 2013", 4 pgs.
"European Application Serial No. 10250039.4, Response filed Jul. 18, 2013 to Examination Notification Art. 94(3) mailed Jan. 16, 2013", 6 pgs.
"European Application Serial No. 10250568.2, Response filed Aug. 19, 2013 to Examination Notification Art. 94(3) mailed Apr. 17, 2013", 10 pgs.
"European Application Serial No. 09250958.7, Summons to Attend Oral Proceedings mailed Mar. 10, 2014", 4 pgs.
"European Application Serial No. 10250039.4, Response filed Nov. 11, 2013 to Examination Notification Art. 94(3) mailed Jan. 8, 2013", 11 pgs.
"Australian Application Serial No. 2009201227, Voluntary Amendment filed Jun. 5, 2009", 7 pgs.
"European Application Serial No. 09250958.7, Response filed Jul. 30, 2014 to Office Action mailed Mar. 10, 2014", 19 pgs.

* cited by examiner

SYSTEM FOR AUTOMATIC FITTING USING REAL EAR MEASUREMENT

RELATED APPLICATION

The present application claims the benefit under 35 U.S.C. 119(e) of U.S. Provisional Patent Application Ser. No. 61/164,347, filed on Mar. 27, 2009, which is incorporated herein by reference in its entirety.

TECHNICAL FIELD

This application relates to hearing assistance devices, and more particularly, to automatic fitting of hearing assistance devices using integrated real ear measurement (REM) in the devices.

BACKGROUND

Hearing assistance devices are electronic devices that provide better listening for wearers. One type of hearing assistance device is a hearing aid. Hearing aids provide signal processing functions such as noise reduction, amplification, and tone control to correct for an individual's own hearing loss. Performance of a user's hearing aid, while in the user's ear, is difficult to measure. However, such measurements may enable better programming of a user's hearing aid because each user's ear is different.

Various prescriptive fitting formulae can be used to calculate custom targets for the hearing aid response. A goal of the fitting is to adjust the gain of the hearing aid so that its output in the patient's ear matches the prescribed targets. This is referred to as target matching. Accurate target matching enhances audibility and comfort for the patient in a variety of listening environments. It is desirable to accurately and quickly perform target matching. It is further desirable to not use extra equipment or a model of hearing aid response to perform the target matching.

Some known target matching methods do not automatically adjust gain. Known target matching methods that automatically adjust gain rely on a model of the hearing aid response. Standalone real-ear measurement systems allow the audiologist to overlay the measured hearing aid response on a desired target curve, and then manually adjust gain settings until the response matches the target. This process usually requires several adjustment-measurement iterations in order to get the response to match the target for multiple input levels. This method is time consuming and inconsistent from user to user. Hearing aid manufacturers' fitting software automatically adjusts gain, but rely on a model of the hearing aid response rather than a measurement to determine the accuracy of the resulting target match. Several factors contribute to the accuracy of the model, and thus the accuracy of the target match. These factors include: differences between the typically-modeled nominal 2 cc coupler response and the actual device response; the accuracy of the transfer functions applied to the 2 cc coupler response to obtain a predicted real ear response (the average 'real-ear-to-coupler difference' (RECD) and the free-field-to-mic effect). A custom-measured RECD may be used to improve the accuracy of this model. The RECD can be measured using a standalone system and then transferred to the software, or it can be measured using an on-board hearing aid measurement which is then automatically integrated into the fitting software.

There is a need in the art for improved systems to assist in measuring the performance of a hearing assistance device while the device is in the user's ear.

SUMMARY

The present subject matter provides apparatus and method for real ear measurements (REM) of hearing assistance devices disposed in the ear of a user. The real ear measurements are used to automatically fit the hearing assistance devices. Examples include, but are not limited to, a hearing assistance device for a wearer having an ear and an ear canal, the wearer having a plurality of target gains determined for the ear, including a microphone adapted to sample sound from the wearer's ear canal, a receiver adapted to play sound to the wearer's ear canal, and hearing assistance electronics in communication with the microphone and the receiver, the hearing assistance electronics programmed to process signals received by the microphone to automatically self-correct frequency dependent gain of signals played by the receiver in the wearer's ear canal to approximate the plurality of target gains. Examples are provided, such as a hearing assistance apparatus for performing a real ear measurement of an acoustic signal in a user's ear canal, comprising means to transform a stimulus signal into a frequency domain stimulus signal with a plurality of frequency ranges, means to amplify the frequency domain stimulus signal with a desired gain for each of the plurality of frequency ranges to provide an amplified stimulus signal, means to transform the amplified stimulus signal into the acoustic signal in the ear canal, means to detect the acoustic signal in the ear canal to provide a detected acoustic signal, means to transform the detected acoustic signal into a frequency domain detected signal with the plurality of frequency ranges, means to measure a detected sound level for the plurality of frequency ranges, and means to adjust the desired gain for the frequency ranges based on the detected sound level for the plurality of frequency ranges and desired sound pressure levels for the plurality of frequency ranges, wherein the desired sound pressure levels are stored in the hearing assistance apparatus.

Another example of a hearing assistance apparatus for performing a REM of an acoustic signal in a user's ear canal includes a first analyzer to convert an electrical stimulus signal into a frequency domain signal with a plurality of frequency ranges, an amplifier to provide an amplified signal with prescriptive gains for the plurality of frequency ranges, a first synthesizer to convert the amplified signal into an amplified time domain stimulus signal, an analog-to-digital converter to convert the amplified time domain stimulus signal into an analog stimulus signal, a receiver to convert the analog stimulus signal into an acoustic signal, a calibrated microphone to detect the acoustic signal in the ear canal, and generate an analog detected signal, an analog-to-digital convert to convert the analog detected signal into a digital detected signal, a second analyzer to convert the digital detected signal into a detected frequency domain signal with the plurality of frequency ranges, a sound pressure level detector to determined measured sound pressure levels for the plurality of frequency ranges in the detected frequency domain signal, a memory for storing desired sound pressure levels for the plurality of frequency ranges, and a gain adjuster to automatically adjust a transfer function of the amplifier based on the desired sound pressure levels and the measured sound pressure levels to adjust the prescriptive gains for the plurality of frequency ranges.

The present subject matter also provides methods for performing a REM to detect sound pressure levels in a user's ear canal using a hearing assistance apparatus. An example of the method is provided and includes transforming a stimulus signal into a frequency domain stimulus signal with a plurality of frequency ranges, amplifying the frequency domain stimulus signal with a desired gain for each of the plurality of frequency ranges to provide an amplified stimulus signal, transforming the amplified stimulus signal into the acoustic signal in the ear canal, detecting the acoustic signal in the ear canal to provide a detected acoustic signal, transforming the detected acoustic signal into a frequency domain detected signal with the plurality of frequency ranges, measuring a sound level for the plurality of frequency ranges, and automatically adjusting the desired gain for each frequency range based on the measured sound levels and the desired sound pressure levels for the plurality of frequency ranges. The method can be performed within the hearing assistance apparatus.

This Summary is an overview of some of the teachings of the present application and is not intended to be an exclusive or exhaustive treatment of the present subject matter. Further details about the present subject matter are found in the detailed description. The scope of the present invention is defined by the appended claims and their equivalents.

DETAILED DESCRIPTION

The following detailed description refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Various embodiments disclosed herein automatically adjust gain of a hearing assistance device without using a model of the hearing aid response. By way of example and not limitation, various embodiments provide new, fast and accurate target matching using the hearing aid and software to simultaneously generate the desired sound to the hearing aid compression algorithm, measure the hearing aid output in the patient's ear, adjust hearing aid gain until the desired real ear response is achieved, and display the response and target throughout the adjustment in the fitting software. The target matching does not require modeling, precise receiver calibration, measured RECD, standalone real ear equipment, or manual adjustments.

Real ear measurements may be used a variety of hearing assistance device housings including, but not limited to, behind-the-ear, in-the-ear, on-the-ear, in-the-canal and completely-in-the-canal devices, as well as receiver-in-the-canal and cochlear implant devices.

Figure 1:
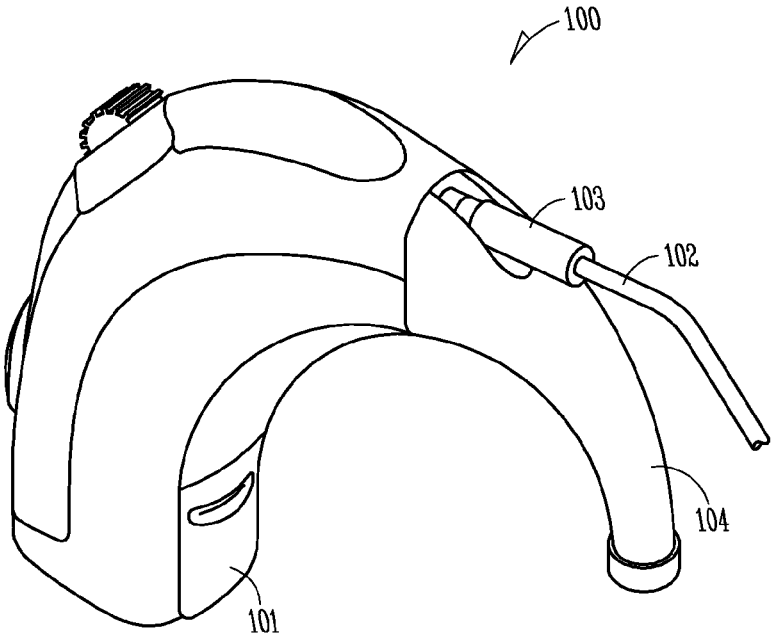
FIG. 1 illustrates an assembled real ear measurement system according to an embodiment of the present subject matter.

FIG. 1 illustrates an assembled real ear measurement system according to an embodiment of the present subject matter. The illustrated system 100 includes a hearing assistance device housing 101, a flexible sound tube 102 with a fitting 103 and an connector 104. In behind-the-ear (BTE) applications using a sound tube, connector 104 is typically an earhook. In receiver-in-canal (RIC) applications using a wired receiver in the ear, the connector 104 is an electrical connector. Other embodiments may employ a wireless connection. The assembled embodiment shows the fitting 103 of the sound tube engaged in the receptacle of the connector 104 attached to the hearing assistance device housing 101.

The sound tube 102 is a flexible tube and is connected to fitting 103 at one end for providing a sound tight connection. The tube is very flexible and allows for insertion into the ear canal along side an earmold. Examples of tube materials include a Dow Corning product, part number Q7-4765, a 60 durometer silicone material. Examples of coupling materials include a Dow Corning product; part number Q74850, a 50 durometer material. The example fitting materials can be compressed to insert into a tight fitting receptacle and upon relaxation tend to expand to the shape of the receptacle, therefore, forming a sound tight seal. The sound tube provides a sound conduit for acoustic signals in the ear canal to a microphone in the housing. Other embodiments provide a microphone in or near the ear canal to detect sound in the ear canal.

Figure 2:
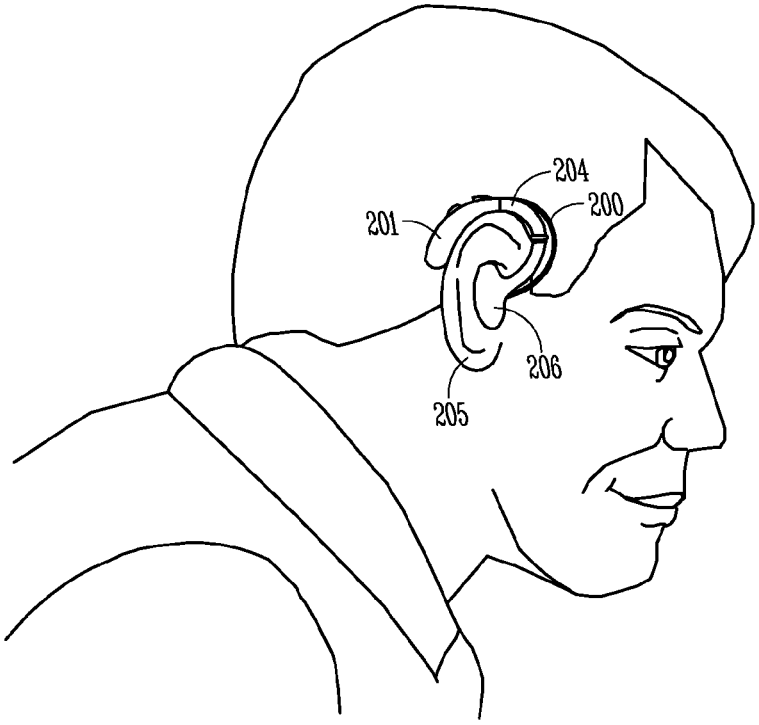
FIG. 2 illustrates an embodiment of a real ear measurement system in place to perform a real ear measurement in an ear of a user.

FIG. 2 illustrates an embodiment of a real ear measurement system in place to perform a real ear measurement in an ear 205 of a user. The illustrated example shows a user wearing a hearing assistance device housing 201 with a connected connector 204 and flexible tube 200. The distal, unconnected end of the flexible tube 200 is inserted into the user's ear canal along side of or otherwise past or through an earpiece 206 connected to the connector 204. The end of the flexible tube extending into the ear canal should be close to the eardrum, for example, approximately 5 mm from the eardrum. In various examples, the thin, flexible tube is connected to housing designs other than the illustrated behind-the-ear design. For example, in-the-ear, on-the-ear, in-the-canal and completely-in-the-canal housings may be employed with the thin, flexible sound tube.

During an ear measurement, a sound is emitted from the receiver of the hearing assistance device. The sound, as detected in the ear canal, is received by a first microphone of the hearing assistance device using the flexible sound tube. Rather than using a sound tube, some embodiments of the hearing assistance device include a microphone situated in or about the wearer's ear canal to detect acoustic signals in the ear canal. In some embodiments, wires lead from the microphone to housing 201.

Figure 3:
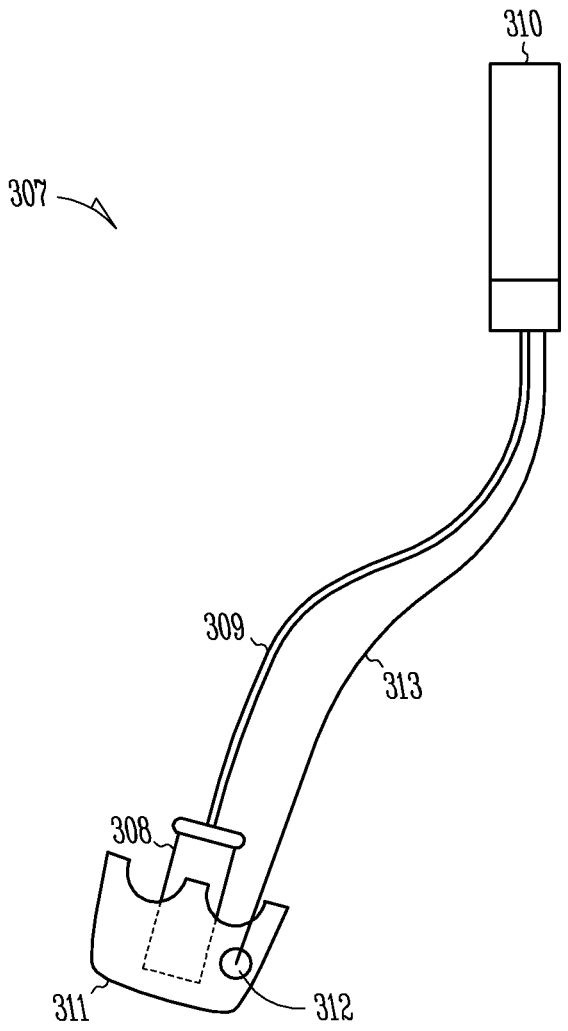
FIG. 3 is an example of a receiver-in-canal (RIC) hearing assistance device application according to one embodiment of the present subject matter.

FIG. 3 is an example of a receiver-in-canal (RIC) hearing assistance device application according to one embodiment of the present subject matter. RIC hearing assistance devices ("RIC devices") include RIC hearing aids. RIC devices 307 include a receiver (or speaker) 308 adapted to be situated in or about the wearer's ear canal with wires 309 leading from the receiver to a housing 310, which may be positioned behind or over the ear. RIC devices may employ earpieces 311 that are standard ear buds or custom earmolds that can be open or vented designs. In the illustrated embodiment, a microphone 312 is mounted in an ear bud and adapted to be situated in or about the wearer's ear canal with wires 313 leading from the microphone 312 to the housing 310. Alternatively, a microphone may be in the housing 310, with a sound tube with one end proximate the microphone and a second end adapted to be situated in or about the wearer's ear canal.

Figure 4:
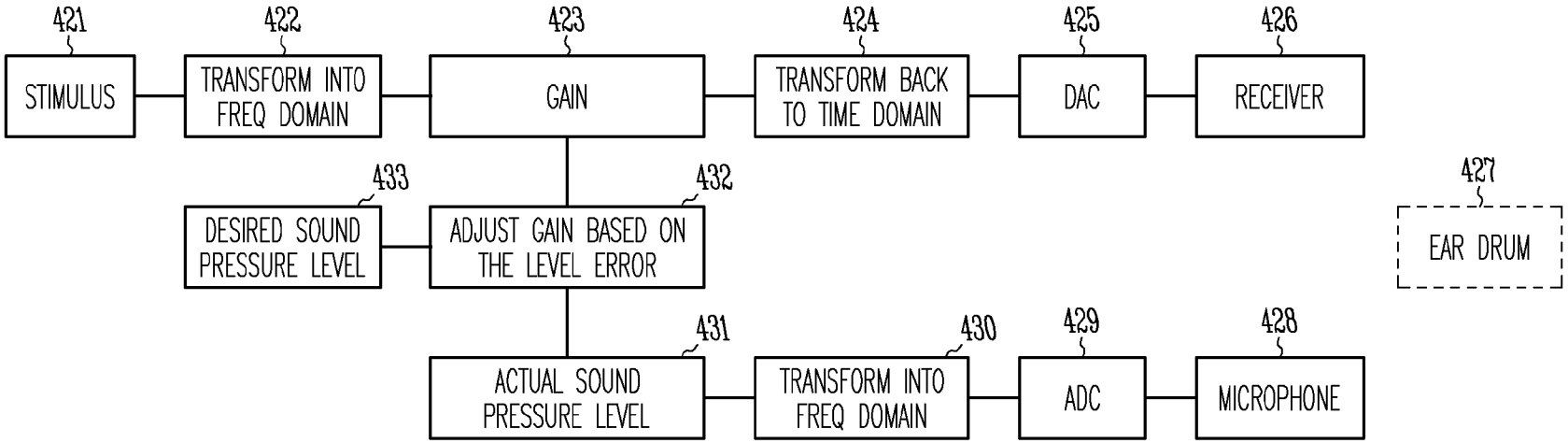
FIGS. 4-6 illustrate various system diagrams to automatically fit a hearing assistance device using real ear measurement according to various embodiments of the present subject matter.
Figure 5:
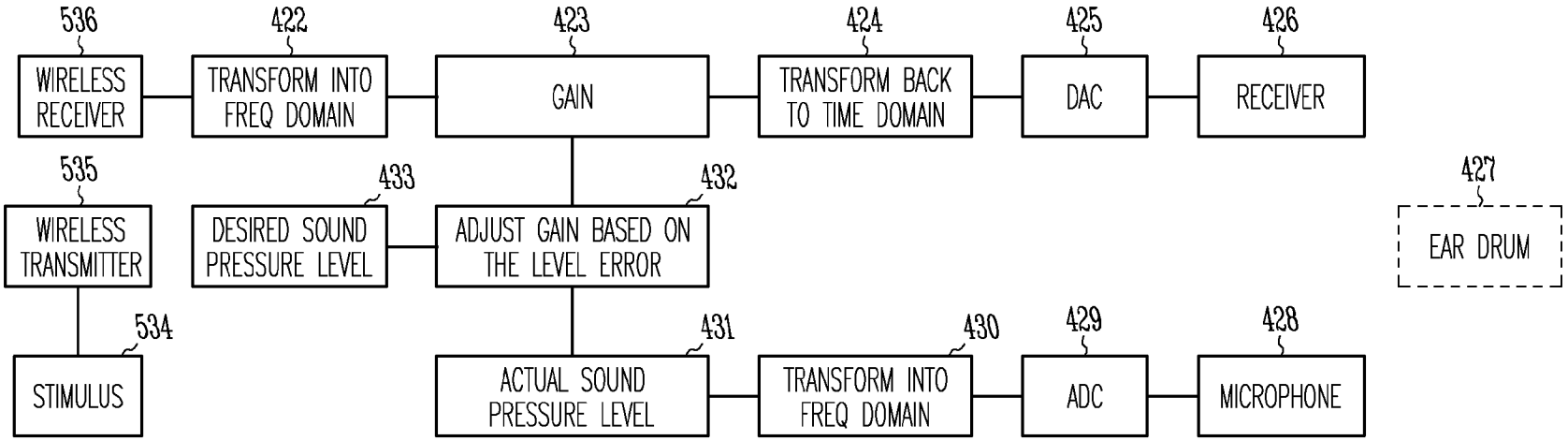
Figure 6:
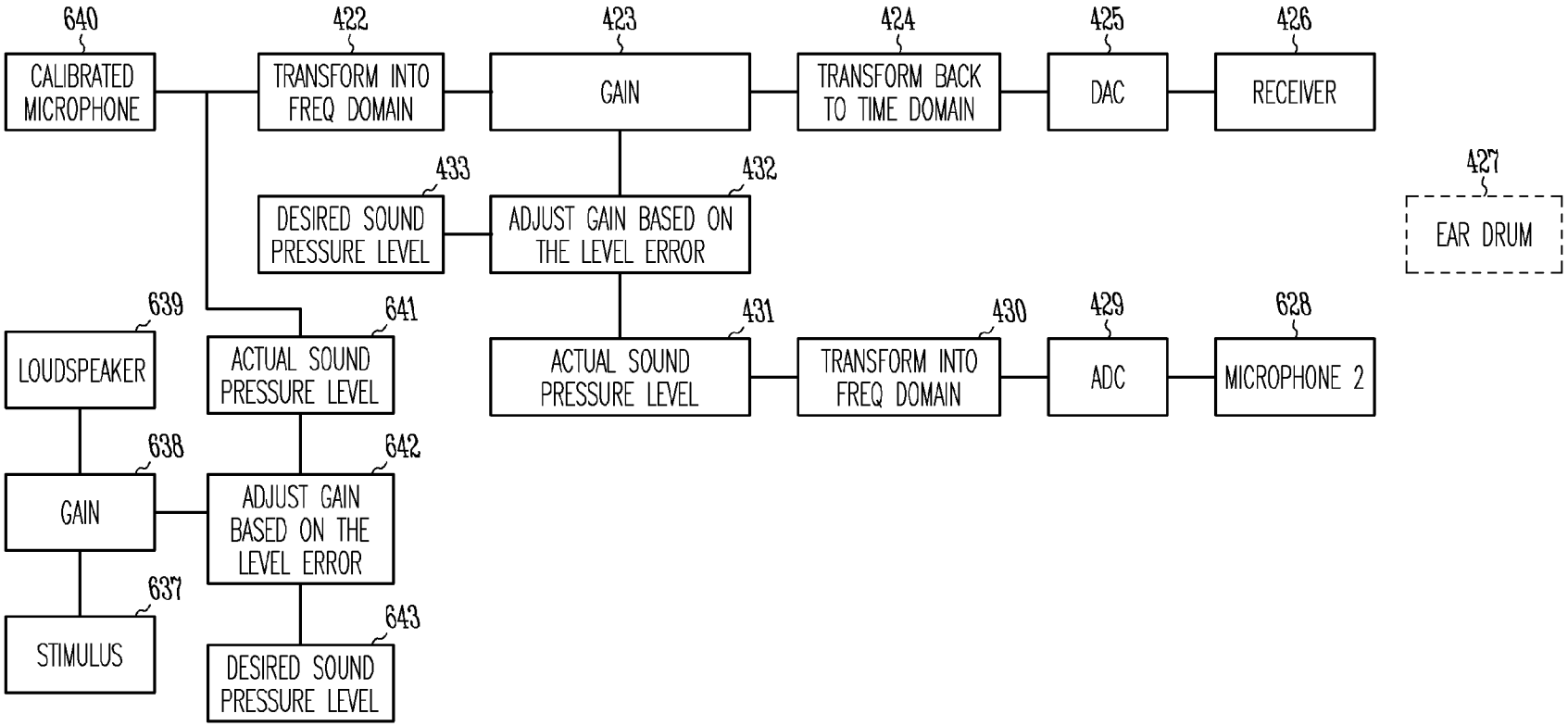

The present subject matter can use an internally generated or recorded stimulus as the input to the hearing aid algorithm, or can use an externally generated stimulus as the input to the hearing aid algorithm. Examples are illustrated in FIGS. 4-6.

The desired sound pressure level is based on the prescriptive targets expressed in real ear sound pressure level. The difference between the measured sound pressure level and the desired sound pressure level is what the software or firmware uses to calculate the needed adjustments.

In one embodiment, one hearing aid microphone is dedicated for real-ear measurement. In another embodiment, one hearing aid microphone is used both as a regular hearing aid microphone and as an optional real-ear measurement microphone. In the latter case, a probe tube may be needed to interface the microphone to the ear canal. In order to use such a system to measure the sound pressure level in the ear canal, its sensitivity needs to be determined for each device. One way to do this is to present a known sound pressure level to the probe tube coupled to the microphone so that its sensitivity can be measured at each frequency in the clinic. The result can be saved into the persistent memory on the device for later use. Another way to do this is to determine a nominal probe tube attenuation factor for the probe tube alone. This can be done by measuring the microphone sensitivity with and without the probe tube attached. The probe tube attenuation factor is given by the microphone sensitivity with the probe tube minus the sensitivity without the probe tube. For a device in the field, the microphone sensitivity with the probe tube attached is given by the microphone sensitivity without the probe tube plus the nominal probe tube attenuation factor.

Various embodiments provide automatic target matching by optimizing all channels simultaneously using the overall matching error (target level−actual level) as the cost function. Various embodiments provide automatic target matching by optimizing one channel at a time using the channel matching error as the cost function.

In one embodiment, the overall target matching error is defined as $$\sum_{i=0}^{N-1} \left|L(i) - L_T(i)\right|$$

Where L(i) is the measured sound pressure at frequency index i; $L_T(i)$ is the target sound pressure at frequency index i; i=0 . . . N−1; N is the number of frequency bins covering the entire frequency range.

In another embodiment, the overall target matching error is defined as $$\sum_{i=0}^{N-1} w(i)\left|L(i) - L_T(i)\right|$$

Where w(i) is the weight factor at frequency index i;

$$\sum_{i=0}^{N-1} w(i) = 1$$

L(i) is the measured sound pressure at frequency index i; $L_T(i)$ is the target sound pressure at frequency index i; i=0 . . . N−1; N is the number of frequency bins covering the entire frequency range.

In yet another embodiment, the overall target matching error is defined as $$\sum_{i=0}^{N-1} w(i)\left|L(i) - L_T(i)\right|^{\alpha}$$

Where w(i) is the weight factor at frequency index i;

$$\sum_{i=0}^{N-1} w(i) = 1$$

α is a positive value; the L(i) is the measured sound pressure at frequency index i; $L_T(i)$ is the target sound pressure at frequency index i; i=0 . . . N−1; N is the number of frequency bins covering the entire frequency range.

In one embodiment, the channel specific target matching error for channel κ is defined as $$\sum_{i=I_k}^{I_{k+1}-1} \left|L(i) - L_T(i)\right|$$

Where L(i) is the measured sound pressure at frequency index i; $L_T(i)$ is the target sound pressure at frequency index i; i=0 . . . N−1; $I_k$ is the first frequency index number of channel k; k=0 . . . K; K is the number of channel; $I_k$ is the last frequency index number of channel κ

In another embodiment, the overall target matching error is defined as $$\sum_{i=0}^{N-1} w(i)\left|L(i) - L_T(i)\right|$$

Where w(i) is the weight factor at frequency index i;

$$\sum_{i=0}^{N-1} w(i) = 1$$

L(i) is the measured sound pressure at frequency index i; $L_T(i)$ is the target sound pressure at frequency index i; i=0 . . . N−1; N is the number of frequency bins covering the entire frequency range.

In yet another embodiment, the overall target matching error is defined as $$\sum_{i=0}^{N-1} w(i)\left|L(i) - L_T(i)\right|^{\alpha}$$

Where w(i) is the weight factor at frequency index i;

$$\sum_{i=0}^{N-1} w(i) = 1$$

$\alpha$ is a positive value; the L(i) is the measured sound pressure at frequency index i; $L_T(i)$ is the target sound pressure at frequency index i; i=0 . . . N−1; N is the number of frequency bins covering the entire frequency range.

In the case of overall target matching error optimization, there are many different methods. In one embodiment, an initial target match is performed based on the hearing aid model in the fitting software. This provides a reasonable starting point for the compressor setting before initiating the actual real-ear measurement. Once the ear canal SPL is obtained, the overall target matching error is calculated. If the overall error is less than a given criterion, the target matching is successfully achieved. Otherwise, the gain is then adjusted in each channel by an amount proportional to the target matching error in the channel. This process is iterated until the overall target matching error is less than a given criterion or the number of iterations has reached a given threshold.

In the case of individual channel target matching error optimization, there are also different methods. In one embodiment, gain is adjusted iteratively one channel at a time until the channel target matching error is less than a given threshold. The process repeats until all channels are optimized. This approach takes longer. In addition, the overall accuracy may not be optimal because gain change in one channel may result in unaccounted change in the output level in an adjacent channel.

FIGS. 4-6 illustrate various system diagrams to automatically fit a hearing assistance device using real ear measurement according to various embodiments of the present subject matter.

FIG. 4 illustrates an embodiment of a system to automatically fit a hearing assistance device using real ear measurement. In one embodiment, the process performed in the illustrated system occurs within a hearing assistance device. The device generates a stimulus signal 421 generated by the hearing assistance device. The stimulus can have different audio characteristics. For example, in one embodiment, the stimulus is a speech-shaped noise. In one embodiment, the stimulus is a speech-shaped tone complex. In various embodiments, the stimulus is a single pure tone or speech signal at a given sound pressure level (e.g., 50, 65 and 80 dB sound pressure level). Other stimuli may be used without departing from the scope of the present subject matter.

The stimulus is transformed by an analyzer 422 into the frequency domain with a plurality of frequency regions, and an amplifier 423 applies a gain, which may be a function of frequency or particular subband. The amplifier has a transfer function, which controls the gain for the different frequency regions. A synthesizer 424 converts the signal from the frequency domain into the time domain. The digital-to-analog converter 425 converts the digital signal into an analog signal, and a receiver 426 converts the analog electrical signal into an acoustic signal. The receiver does not need to be precisely calibrated. The receiver may be in the ear canal, as in RIC designs, or may be in the housing of the hearing assistance device, as in behind-the-ear or over-the-ear designs. The acoustic signal is delivered to the ear drum 427. The real-ear-measurement uses a calibrated microphone 428 to measure the sound pressure level at or near the ear drum. The microphone may be physically located in the ear canal, or a sound tube or probe tube may be used with a first end in the ear canal and a second end near the microphone. An analog-to-digital converter 429 converts the signal from the microphone into a digital signal, and the digital signal is transformed into the frequency domain by analyzer 430. The transformation performed by analyzer 430 represents the same transformation as performed by analyzer 422. The actual or measured sound pressure level for the different frequencies is detected at 431, compared to a desired sound pressure for the frequencies at 433 to determine a sound pressure error and a gain adjustment to compensate for the error. For example, the transfer function of the amplifier can be adjusted to provide the desired sound levels in the ear canal at the desired frequencies. The function illustrated at 432 can be performed using an adaptive filter. The gain adjustment is used to adjust the gain 432 for the different frequencies at 423 to provide an actual sound pressure at the ear drum that matches the desired sound pressure level. The present subject matter can achieve the target matching using the integrated real-ear measurement in the hearing aid alone. Because no external acoustic signal is required, this embodiment has high reliability in noisy environments.

FIG. 5 illustrates another embodiment of a system to automatically fit a hearing assistance device using real ear measurement. The illustrated process is similar to that illustrated in FIG. 4, except that the stimulus 534, or stimulus information, is generated external to the hearing assistance device, and transmitted to the device using a wireless transmitter 535. The hearing assistance device includes a wireless receiver 536 to receive the wireless transmission with the stimulus. The wireless transmission may transmit the stimulus itself, or information used by the hearing assistance device to generate the stimulus. The stimulus can have different audio characteristics. For example, in one embodiment, the stimulus is a speech-shaped noise. In one embodiment, the stimulus is a speech-shaped tone complex. In various embodiments, the stimulus is a single pure tone or speech signal at a given sound pressure level (e.g., 50, 65 and 80 dB sound pressure level). Other stimuli may be used without departing from the scope of the present subject matter.

FIG. 6 illustrates another embodiment of a system to automatically fit a hearing assistance device using real ear measurement. The illustrated process is similar to that illustrated in FIG. 4, except that the stimulus 637 is generated external to the hearing assistance device, and acoustically delivered to the device. With the externally provided acoustic stimulus, the present subject matter can evaluate the effect of vent or open fitting in one setup in addition to target matching. An external device generates a stimulus signal 637, and applies a gain to the signal at 638. The stimulus can have different audio characteristics. For example, in one embodiment, the stimulus is a speech-shaped noise. In one embodiment, the stimulus is a speech-shaped tone complex. In various embodiments, the stimulus is a single pure tone or speech signal at a given sound pressure level (e.g., 50, 65 and 80 dB sound pressure level). Other stimuli may be used without departing from the scope of the present subject matter. A loudspeaker 639 converts the signal with the gain into an acoustic signal. The hearing assistance device includes a calibrated microphone 640 to receive the acoustic stimulus signal from the loudspeaker 639. The hearing aid microphone can be used to ensure that the precise stimulus level is delivered to the hearing aid microphone. The actual sound pressure level received by the microphone is detected at 641, compared to a desired sound pressure level at 643 to determine an error, and provide a gain adjustment at 642 used to modify the gain at 638.

As illustrated herein, embodiments of the present subject matter do not need a standalone real-ear measurement system or a model of the hearing aid response. Rather, the sound pressure level in the canal is measured directly. As a result, target matching is much more accurate, and has a high tolerance for head movement.

Various embodiments provide automatic target matching by optimizing all channels simultaneously using the overall matching error (target level−actual level) as the cost function. Various embodiments provide automatic target matching by optimizing one channel at a time using the channel matching error as the cost function.

The present subject matter can achieve the target matching using the integrated real-ear measurement in the hearing aid, a PC software, a programmer and a personal computer including a sound card and a loudspeaker. The actual target matching process can be displayed in real-time in the fitting software.

Figure 7:
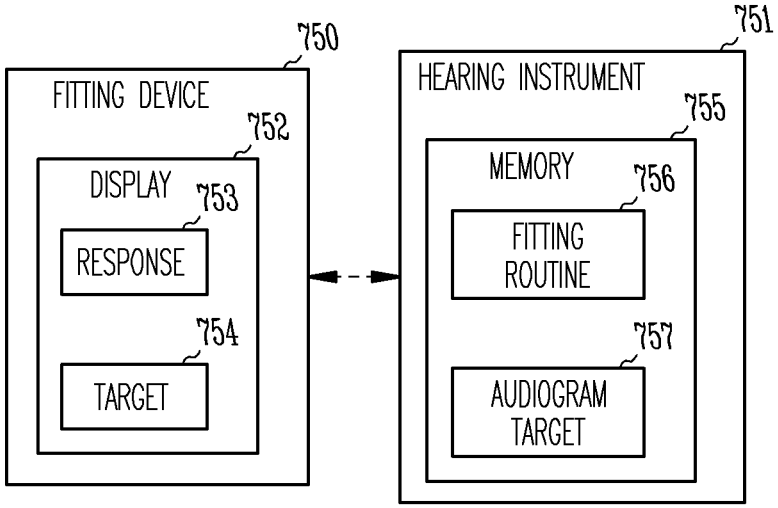
FIG. 7 illustrates a system for automatically fitting a hearing instrument, according to one embodiment of the present subject matter.

FIG. 7 illustrates a system for automatically fitting a hearing instrument, according to one embodiment of the present subject matter. The illustrated system includes a fitting device 750 and a hearing instrument 751. The illustrated device includes a display, on which the actual response 753 and target 754 can be displayed. The illustrated hearing instrument 751 includes a memory 755. Various embodiments of the hearing instrument 751 include a fitting routine 756 stored in the memory 755. In some embodiments, the hearing assistance device is in communication with a programmer. The programmer sends a command to initiate a fitting procedure. In other embodiments, a programmer is not connected and the fitting procedure is initiated using the controls of the hearing assistance device. Various embodiments of the hearing instrument 751 include an audiogram target 757 stored in the memory 755. The audiogram target 757 identifies the hearing loss of the wearer at various frequencies. This audiogram target 757 is used to identify the desired sound pressure level (e.g. 433) at or near the ear drum for each frequency range, and these desired sound pressure levels are compared to actual sound pressure level (e.g. 431) to automatically adjust the gain for the frequency ranges to provide the desired sound pressure levels according to the audiogram.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A hearing assistance device for a wearer having an ear and an ear canal, the wearer having a plurality of target gains determined for the ear, comprising:

a housing;

a hearing assistance device microphone within the housing adapted to sample sound from the wearer's ear canal using a probe tube, the hearing assistance device microphone situated in an opening of the ear canal and configured to be used as both a device microphone and a real-ear measurement microphone;

a receiver adapted to play a sound stimulus to the wearer's ear canal; and hearing assistance electronics within the housing in communication with the hearing assistance device microphone and the receiver, the hearing assistance electronics programmed to process signals received by the hearing assistance device microphone to automatically self-correct frequency dependent gain of signals played by the receiver in the wearer's ear canal using real-ear measurements by the hearing assistance device microphone to approximate the plurality of target gains for each of a plurality of frequency ranges by iterating until an overall target matching error for the plurality of frequency ranges is less than a programmable threshold by adjusting gain in each frequency range by an amount proportional to the target matching error for the frequency range, wherein the hearing assistance electronics use an attenuation factor of the probe tube to process the signals.

2. The device of claim 1, wherein the hearing assistance electronics include an analyzer adapted to transform the sound stimulus into frequency domain.

3. The device of claim 1, wherein the hearing assistance electronics include an amplifier adapted to apply a gain as a function of frequency.

4. The device of claim 3, wherein the amplifier is adapted to apply a gain as a function of a subband.

5. The device of claim 4, wherein the amplifier includes a transfer function adapted to control the gain for each subband.

6. The device of claim 1, wherein the hearing assistance electronics include a memory adapted to store an audiogram target.

7. The device of claim 1, wherein the hearing assistance device includes a completely-in-the-canal (CIC) hearing assistance device.

8. The device of claim 1, wherein the hearing assistance device includes a receiver-in-the-canal (RIC) hearing assistance device.

9. The device of claim 1, wherein the hearing assistance device includes a behind-the-ear hearing (BTE) assistance device.

10. A method for automatically adjusting gain of a hearing assistance device for a wearer having an ear and an ear canal, the method comprising:

generating an acoustic stimulus signal;

playing the acoustic stimulus signal in the ear canal using a receiver;

detecting signals in the ear canal using a hearing assistance device microphone within a housing of the hearing assistance device, the hearing assistance device microphone situated in an opening of the ear canal and configured to be used as both a device microphone and a real-ear measurement microphone using a probe tube; and processing signals received by the hearing assistance device microphone to automatically self-correct frequency dependent gain using real-ear measurements by the hearing assistance device microphone to approximate a plurality of target gains for each of a plurality of frequency ranges for the wearer by iterating until an overall target matching error for the plurality of frequency ranges is less than a programmable threshold by adjusting gain in each frequency range by an amount proportional to the target matching error for the frequency range, including using an attenuation factor of the probe tube to process the signals.

11. The method of claim 10, wherein generating an acoustic signal includes transforming a stimulus signal into a frequency domain stimulus signal with a plurality of frequency ranges.

12. The method of claim 11, further comprising amplifying the frequency domain stimulus signal with a desired gain for each of the plurality of frequency ranges to provide an amplified stimulus signal.

13. The method of claim 12, further comprising transforming the amplified signal into the acoustic stimulus signal in the ear canal.

14. The method of claim 13, further comprising transforming the detected signals into a frequency domain detected signal with the plurality of frequency ranges.

15. The method of claim 14, further comprising measuring a sound level for the plurality of frequency ranges.

16. The method of claim 15, further comprising automatically adjusting gain for each frequency range based on the measured sound levels and desired sound pressure levels for the plurality of frequency ranges.

17. The method of claim 10, further comprising displaying a measured response.

18. The method of claim 10, further comprising displaying a target response.

19. The method of claim 10, wherein generating an acoustic stimulus signal includes generating the stimulus signal in the hearing assistance device.

20. The method of claim 10, wherein generating an acoustic stimulus signal includes generating the stimulus signal externally to the hearing assistance device.

* * * * *